United States Patent [19]

Anderson et al.

[11] 4,119,411

[45] Oct. 10, 1978

[54] COAL GASIFICATION PLANT

[75] Inventors: John Alfred Anderson, Knowle; Dennis Hebden, Guildford, both of England

[73] Assignee: British Gas Corporation, London, England

[21] Appl. No.: 744,035

[22] Filed: Nov. 22, 1976

[30] Foreign Application Priority Data

Nov. 27, 1975 [GB] United Kingdom ..... 48816/75

[51] Int. Cl.[2] ..... B01J 3/00

[52] U.S. Cl. ..... 48/62 R; 48/77; 48/DIG. 2; 65/172; 110/266; 266/236

[58] Field of Search ..... 48/77, 76, 62 R, 92, 48/63, 202, 210, 197 R, DIG. 2; 110/28 P, 165 R; 122/235 N; 65/19, 172; 266/236; 164/337, 335; 222/591, 592

[56] References Cited

U.S. PATENT DOCUMENTS

| | | | |
|---|---|---|---|
| 1,608,967 | 11/1926 | Tucker et al. | 65/172 |
| 2,961,722 | 11/1960 | Lilljekvist et al. | 222/591 |
| 3,018,174 | 1/1962 | Steever | 48/63 |
| 3,459,346 | 8/1969 | Tinnes | 164/337 |
| 3,730,401 | 5/1973 | Bode | 164/337 |
| 3,741,136 | 6/1973 | Stookey | 122/235 N |
| 3,749,387 | 7/1973 | Andrzejak et al. | 164/337 |

FOREIGN PATENT DOCUMENTS

| | | | |
|---|---|---|---|
| 266,180 | 3/1966 | Australia | 48/76 |
| 1,922,232 | 11/1969 | Fed. Rep. of Germany | 65/172 |

*Primary Examiner*—S. Leon Bashore
*Assistant Examiner*—George C. Yeung
*Attorney, Agent, or Firm*—Larson, Taylor and Hinds

[57] ABSTRACT

An easily removable unit connecting a pressurized gasifier vessel with a slag quenching chamber, wherein the unit consists of a flanged cylindrical tube arranged to carry the slag tap, burner and all services, supplies, electrical cables to and from the gasifier.

4 Claims, 2 Drawing Figures

Figure 1:
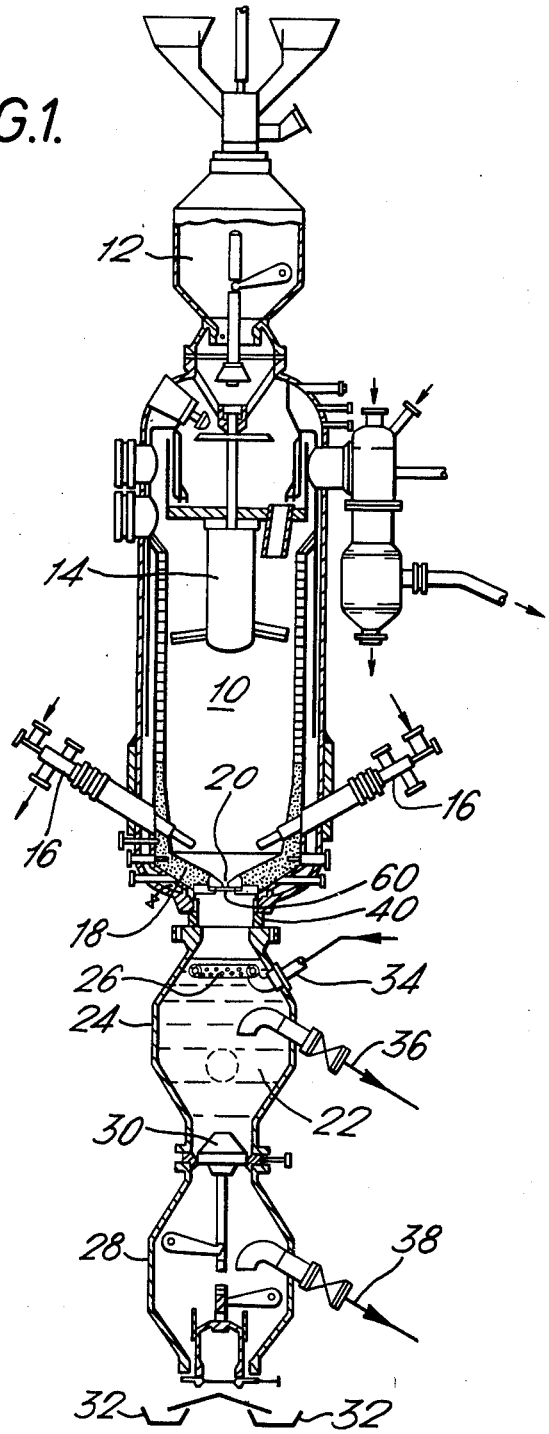

18
66
67
48
51
68
69
46
40
42
65
50
54
60
47
52
49
50
61
58
62
64
62
56
44

COAL GASIFICATION PLANT

This invention relates to coal gasification plant, and more particularly to a quenching chamber arrangement for use in slagging gasifier plants of the kind (hereinafter referred to as the kind specified) in which coal, or other carbonaceous fuel, is introduced into the top of a column-like gasifying vessel and is gasified under high pressure and temperature by means of a gas, for example oxygen and steam, introduced into the fuel bed through tuyeres. The residual ash collects as a molten slag and iron in the hearth of the gasifier vessel from which it is periodically discharged (commonly known as slag-tapping) downwardly through a slag tap outlet or orifice in the hearth into water contained in a quenching chamber vessel. Usually, a pool of molten slag and iron is maintained in the hearth by directing hot combustion products from a burner located beneath the slag tap orifice up the tap orifice to retain the pool of slag and iron in the hearth, the tapping of the molten slag and iron being initiated and controlled by stopping or reducing the burner output and reducing the pressure in the quenching chamber by controlled venting through its venting system so as to produce a differential pressure between the quenching chamber and the gasifier vessel.

Examples of such slagging gasifier plant are those disclosed in United Kingdom patent specification No. 977,122, The Gas Council Research Communication Nos. GC 50 and GC 112.

According to the present invention, in a slagging gasifier of the kind specified there is provided an annular metal structure having means for supporting a central part of the hearth including at least the slag tap and main burner and means by which the structure can be detachably secured in a gas-tight manner between the lower end of the gasifier vessel and the upper end of the quenching chamber, the arrangement being such that, in the secured position of the structure, said central part of the hearth including at least the slag tap and main burner are located in a desired position with respect to the gasifier vessel, but in the detached position of the structure, said central part of the hearth including at least the slag tap and main burner can be readily removed from the gasifier vessel with the structure.

Such an assembly provides a convenient means whereby maintenance on the slag tap, burner, other ancillary apparatus together with associated gas, air, oxygen, coolant fluids and other service inlets and outlets thereto or therefrom of the gasifier can be quickly carried out by removing the assembly from between the gasifier vessel and the quenching chamber. Possibly, so as to avoid any delay in operation of the gasifier whilst this maintenance work is being carried out, a fresh standby structure complete with the aforesaid components can be readily installed in the gasifier.

Preferably, the structure comprises a cylindrical metal sleeve having a flange at its lower end through which the service inlets and outlets pass from the outside to the inside of the structure, and an annular block fixed at the upper end of the sleeve arranged to support at least said slag tap and burner, the arrangement being such that the structure is clamped in said position in the gasifier by means of its flange which is securely sandwiched between flanged parts of the gasifier chamber and quenching chamber respectively by suitable clamping means, for example, bolts associated therewith.

In some cases, for example where only the slag tap and/or burner require servicing or replacing, then the structure may include further means detachably secured to said structure and arranged to support at least the slag tag and main burner. This further detachable means preferably comprises a cylindrical collar having a flange which is detachably secured to the annular block and co-axially with its central aperture.

Figure 2:
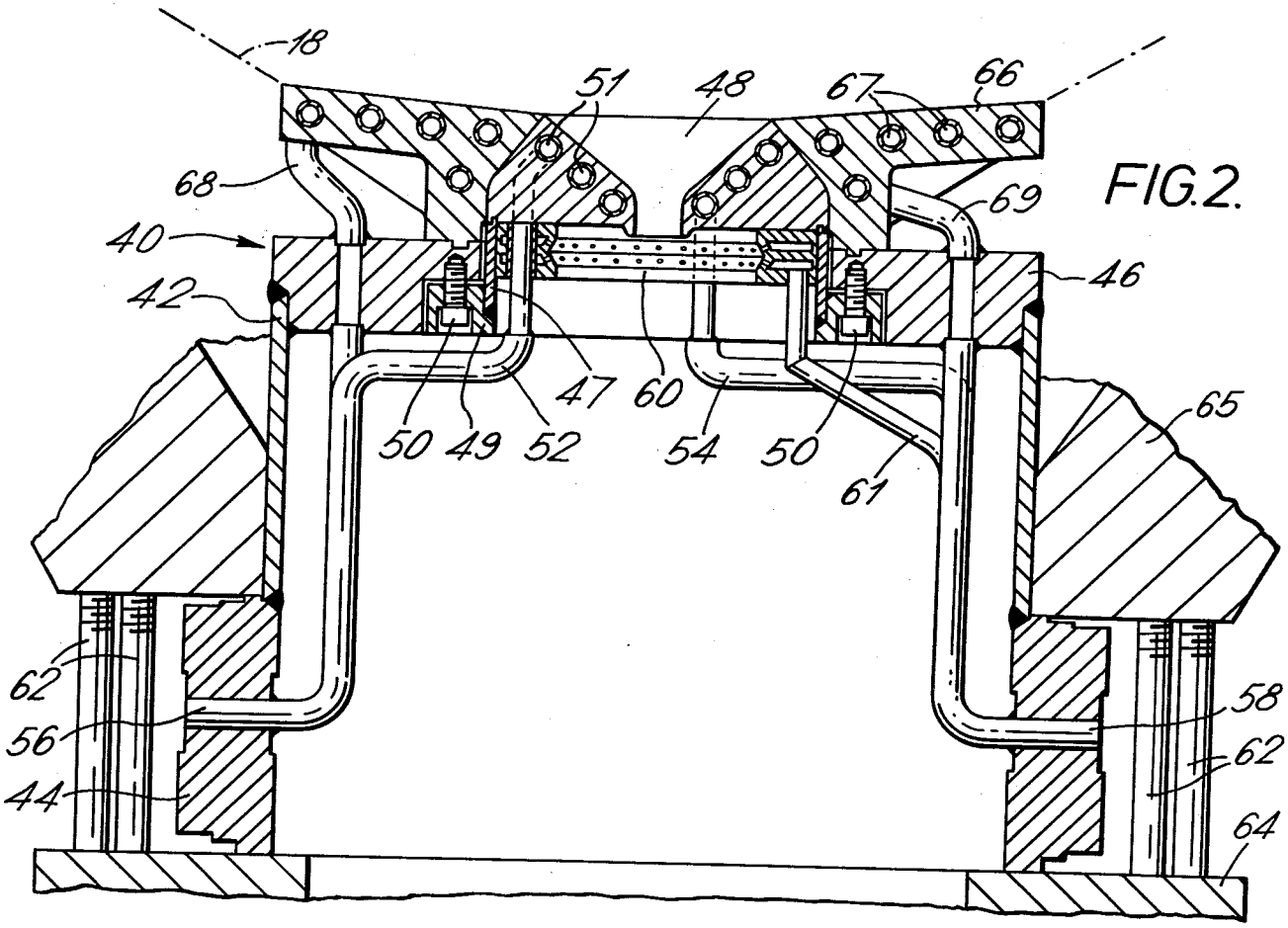

One embodiment of the invention will now be described, by way of example, with reference to the accompanying diagrammatic drawings, in which:

FIG. 1 is a general longitudinal sectional elevation of a fixed-bed of a slagging gasifier incorporating a flange assembly in accordance with the invention, and FIG. 2 is an enlarged longitudinal sectional elevation of the flange assembly between the quenching chamber and the gasifying chamber shown in FIG. 1.

Referring first to FIG. 1, the gasifier has a refractory-lined pressurised gasification chamber 10 into which coal is fed from a lock hopper 12 and distributed by rotatable distributor means 14. Oxygen and steam are introduced into the fuel bed (not shown) through tuyeres 16 to promote gasification of the coal. In use of the gasifier, a reservoir of molten slag collects on the sloping hearth 18 and is perodically passed, via a slag outlet or tap 20, into a water reservoir 22 contained in a quenching chamber 24 where it is rapidly quenched in a region of turbulent water issuing from a perforated tubular ring 26 before being transferred to a lock hopper 28 in the form of a dense small-grained frit entrained with some of the quenching water on operation of a valve 30. The frit is discharged from the lock hopper 28 onto moving conveyors 32. Water supplied to the quench ring 26 through an inlet 34 may partly be water recirculated through outlets 36, 38 from the quenching chamber and slag lock hopper 24, 28 respectively by pump and filter means (not shown).

Referring also to FIG. 2, the quenching chamber 24 is secured in a gas tight manner to the bottom of the gasifier chamber 10 through the intermediary of a sandwich flange assembly 40. This consists of a cylindrical steel sleeve 42 having a thick steel flange member 44 welded to its lower end and a steel annular block 46 welded to its upper end. A slag tap 48 is supported on top of a collar 47 which is welded to a ring 49 secured to the underside of the block by bolts 50. Coolant water is fed to coiled waterways 51 formed in the slag tap 48 through inlet and outlet pipes 52, 54 whose external connections 56, 58 pass through the flange 44. A nozzle-mix ring burner 60 is secured co-axially within the collar 47 about its central aperture, and the air and/or oxygen and gas supply pipes 61 thereto (only one of which is seen) have terminal connections (not shown) in the flange 44. With this arrangement, the burner 60 and the slag tap 48 can be readily removed by first uncoupling the coolant inlet and outlet pipes 52, 54 to the slag tap and the supply pipes 61 to the burner, and then unbolting and lowering the ring 49 with its sleeve 47.

In a similar manner, the supplies and services to and from other ancillary apparatus (not shown), for example, venting means for reducing the pressure in the communicating quenching chamber 24, burner ignition and flame detection devices, thermocouples and other coolant fluid supplies, together with inspection sight glasses for viewing conditions inside the flange assembly, can all have terminal connections in the flange 44 so as to be readily removably therewith from the gasifier vessel. The sandwich flange assembly may also support an annular hearth member 66 having water-cooled passages 67 whose inlet and outlet pipes 68, 69 can have terminal connections (not shown) in the flange 44.

Preferably, the assembly 40 is secured in position in a gas tight manner by means of bolts 62 which draw up the flange 64 of the quenching chamber towards the flange 65 at the base of the gasifier chamber so as to clamp the flange 44 of the assembly therebetween.

Should any maintenance be required to the slag tap burner or other apparatus or services, it is a relatively easy operation to remove the bolts 62, from between the flanges 64 and 65, disconnect the service connections to the terminals in the flange 44, and move the composite quench vessel and slag lock hopper 24, 28 sideways (possibly on guide rails) so as to enable the complete flange assembly 40 to be withdrawn from the base of the gasifier vessel for servicing or possibly replacement with a standby assembly. In some cases, however, where only the slag tap and/or burner require servicing or replacement, then this can be done as aforesaid without removing the whole of the sandwich flange assembly.

We claim:

1. In a slagging gasifier comprising: a gasifying vessel; means for introducing coal into said vessel for gasification thereof in said vessel; means for introducing a gasifying medium into said vessel to effect gasification of coal therein; a hearth located at the bottom of said vessel and including a central slag removal orifice formed in a removable slag tap member positioned at said hearth for removing slag therefrom; a burner positioned beneath said slag removal orifice arranged to direct hot combustion products up the orifice for maintaining a pool of molten slag in said hearth; and a quenching chamber vessel below said gasifying vessel into which molten slag is periodically discharged downwardly from said hearth through said orifice onto said quenching chamber vessel; the improvement wherein there is provided an annular metal structure including means for supporting said slag tap member and said burner in their said positions with respect to the gasifier vessel, and means for detachably securing said structure in a gas-tight manner in operating position between the lower end of said gasifier vessel and the upper end of said quenching chamber vessel with said slag tap member and said burner being supported in their said positions, said annular metal structure forming a gas-tight passageway for material passing between said quenching chamber and said gasifier vessel.

2. A slagging gasifier according to claim 1 wherein said annular metal structure comprises a cylindrical metal sleeve having a flange member fixed at its lower end arranged to fit between respective flanged parts of the gasifier vessel and quenching chamber means, an annular metal block fixed to the upper end of said sleeve and supporting said slag tap member and said burner, wherein said flange member includes means for carrying conduits connected internally to said slag tap member and said burner for connection to fluid supply thereto, and wherein said means for detachably securing said structure comprises clamping means for detachably securing said flange between said flanged parts.

3. A slagging gasifier according to claim 1 wherein said supporting means comprises a support member detachably secured to said annular metal structure.

4. A slagging gasifier according to claim 3, wherein said support member comprises a cylindrical collar supporting said slag tap and main burner, said collar having a ring at its lower end, and being detachably secured to said annular block with its collar projecting co-axially within the central aperture of the annular block, the arrangement being such that the slag tap and burner can be withdrawn from the gasifier hearth through said central aperture in the annular block when the ringed collar is detached from the block.

* * * * *